US010546674B2

(12) United States Patent
Yoshizawa

(10) Patent No.: US 10,546,674 B2
(45) Date of Patent: Jan. 28, 2020

(54) FE-BASED SOFT MAGNETIC ALLOY RIBBON AND MAGNETIC CORE COMPRISING SAME

(71) Applicant: HITACHI METALS, LTD., Tokyo (JP)

(72) Inventor: Yoshihito Yoshizawa, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 296 days.

(21) Appl. No.: 15/533,929

(22) PCT Filed: Nov. 19, 2015

(86) PCT No.: PCT/JP2015/082491
§ 371 (c)(1),
(2) Date: Jun. 7, 2017

(87) PCT Pub. No.: WO2016/104000
PCT Pub. Date: Jun. 30, 2016

(65) Prior Publication Data

US 2017/0323712 A1 Nov. 9, 2017

(30) Foreign Application Priority Data

Dec. 22, 2014 (JP) ..... 2014-258562

(51) Int. Cl.
*H01F 1/153* (2006.01)
*C22C 45/02* (2006.01)
(Continued)

(52) U.S. Cl.
CPC ..... *H01F 1/15308* (2013.01); *C21D 1/04* (2013.01); *C21D 6/001* (2013.01); *C21D 6/007* (2013.01);
(Continued)

(58) Field of Classification Search
None
See application file for complete search history.

(56) References Cited

U.S. PATENT DOCUMENTS 4,881,989 A 11/1989 Yoshizawa et al.
5,160,379 A 11/1992 Yoshizawa et al.
(Continued)

FOREIGN PATENT DOCUMENTS

CN 1185012 A 6/1998
CN 101080788 A 11/2007
(Continued)

OTHER PUBLICATIONS

Extended European Search Report issued by the European Patent Office dated Apr. 11, 2018, which corresponds to EP15872569.7—1103 and is related to U.S. Appl. No. 15/533,929.
(Continued)

*Primary Examiner* — Kevin M Bernatz
(74) *Attorney, Agent, or Firm* — Studebaker & Brackett PC

(57) ABSTRACT

Conventional Fe-based soft magnetic alloy ribbons each containing Co and Ni have a problem that magnetic anisotropy that is neatly arranged in one direction cannot be induced easily even by a magnetic field annealing treatment and, therefore, a wound magnetic cores, a problem that a residual magnetic flux density Br is high, a problem that the hysteresis of the B—H curve becomes large (coercivity Hc becomes large), a problem that the change in incremental permeability relative to superimposed magnetic field becomes large, and others. In order to solve the problems, provided is an Fe-based soft magnetic alloy ribbon including a Cu-concentrated region present directly below a surface of the ribbon, and a Co-concentrated region present directly
(Continued)

below the Cu-concentrated region. Also provided is a magnetic core including the Fe-based soft magnetic alloy ribbon.

9 Claims, 3 Drawing Sheets

(51) Int. Cl.

| | |
|---|---|
| ***H01F 1/16*** | (2006.01) |
| ***C22C 38/00*** | (2006.01) |
| ***C21D 1/04*** | (2006.01) |
| ***C21D 6/00*** | (2006.01) |
| ***C21D 8/02*** | (2006.01) |
| ***C21D 8/12*** | (2006.01) |
| ***C21D 9/52*** | (2006.01) |
| ***C22C 38/02*** | (2006.01) |
| ***C22C 38/04*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| *H01F 38/20* | (2006.01) |

(52) U.S. Cl.

CPC ..... *C21D 6/008* (2013.01); *C21D 8/0205* (2013.01); *C21D 8/0263* (2013.01); *C21D 8/1261* (2013.01); *C21D 9/52* (2013.01); *C22C 38/00* (2013.01); *C22C 38/002* (2013.01); *C22C 38/008* (2013.01); *C22C 38/02* (2013.01); *C22C 38/04* (2013.01); *C22C 38/105* (2013.01); *C22C 38/12* (2013.01); *C22C 38/14* (2013.01); *C22C 38/16* (2013.01); *C22C 45/02* (2013.01); *H01F 1/16* (2013.01); *C21D 6/00* (2013.01); *C22C 2202/02* (2013.01); *H01F 38/20* (2013.01)

(56) References Cited

U.S. PATENT DOCUMENTS

| | | | | |
|---|---|---|---|---|
| 5,800,635 | A * | 9/1998 | Collins | G08B 13/2408 148/304 |
| 5,911,840 | A | 6/1999 | Couderchon et al. | |
| 8,414,712 | B2 * | 4/2013 | Yoshizawa | B82Y 30/00 148/304 |
| 9,222,145 | B2 * | 12/2015 | Ohta | B82Y 25/00 |
| 2006/0077030 | A1 | 4/2006 | Herzer et al. | |
| 2008/0129437 | A1 | 6/2008 | Yoshizawa et al. | |
| 2008/0196795 | A1 | 8/2008 | Waeckerle et al. | |
| 2010/0040503 | A1 | 2/2010 | Yoshizawa et al. | |
| 2010/0084056 | A1 | 4/2010 | Ohta et al. | |
| 2010/0108196 | A1 * | 5/2010 | Ohta | C21D 8/1211 148/121 |
| 2010/0230010 | A1 | 9/2010 | Yoshizawa et al. | |
| 2011/0272065 | A1 | 11/2011 | Ohta et al. | |
| 2015/0243421 | A1 | 8/2015 | Ohta et al. | |

FOREIGN PATENT DOCUMENTS

| | | | | |
|---|---|---|---|---|
| CN | 101663410 | A | 3/2010 | |
| EP | 1840906 | A1 * | 10/2007 | C22C 38/002 |
| EP | 1840906 | A1 | 10/2007 | |
| EP | 2128292 | A1 | 12/2009 | |
| EP | 2149616 | A1 | 2/2010 | |
| JP | S64-079342 | A | 3/1989 | |
| JP | H01-242755 | A | 9/1989 | |
| JP | 2000-277357 | A | 10/2000 | |
| JP | 2006-525655 | A | 11/2006 | |
| JP | 2008-231462 | A | 10/2008 | |
| JP | 2008-231534 | A | 10/2008 | |
| JP | 2009-501273 | A | 1/2009 | |
| JP | 2009-263775 | A | 11/2009 | |
| JP | 2010-229466 | A | 10/2010 | |
| JP | 2013-243370 | A | 12/2013 | |
| WO | 2004/088681 | A2 | 10/2004 | |
| WO | 2006/064920 | A1 | 6/2006 | |
| WO | 2008/133302 | A1 | 11/2008 | |
| WO | 2010/084888 | A1 | 7/2010 | |
| WO | 2014/038705 | A1 | 3/2014 | |

OTHER PUBLICATIONS

An Office Action issued by the Chinese Patent Office (SIPO) dated May 2, 2018, which corresponds to Chinese Patent Application No. 201580069635.X and is related to U.S. Appl. No. 15/533,929; with English language translation.

An Office Action mailed by the State Intellectual Property Office of People's Republic of China dated Jan. 9, 2019, which corresponds to Chinese Patent Application No. 201580069635.X and is related to U.S. Appl. No. 15/533,929; with English translation.

International Search Report issued in PCT/JP2015/082491; dated Februaury 23, 2016.

Written Opinion issued in PCT/JP2015/082491; dated Februaury 23, 2016.

An Office Action; "Notice of Reasons for Refusal," issued by the Japanese Patent Office dated Jul. 9, 2019, which corresponds to Japanese Patent Application No. 2016-566040 and is related to U.S. Appl. No. 15/533,929; with English language translation.

* cited by examiner

FE-BASED SOFT MAGNETIC ALLOY RIBBON AND MAGNETIC CORE COMPRISING SAME

CROSS-REFERENCE TO RELATED APPLICATION

This application is based on and claims priorities under 35 USC 119 from Japanese Patent Application No. 2014-258562 filed on Dec. 22, 2014.

TECHNICAL FIELD

The present invention relates to an Fe-based soft magnetic alloy ribbon and a magnetic core using the same, which is suitable for various magnetic components such as a current transformer, a noise suppression component, a high frequency transformer, a choke coil, and a core for accelerator.

BACKGROUND ART

In the related art, a magnetic core formed of a soft magnetic material such as soft ferrite, an amorphous soft magnetic alloy, a permalloy, and a nanocrystalline soft magnetic alloy, which exhibit properties of high permeability and low magnetic core loss, has been used for various magnetic components such as a current transformer, a noise suppression component, a high frequency transformer, a choke coil, and a core for accelerator.

For example, the soft ferrite is excellent in high frequency properties, but has a low saturation magnetic flux density Bs, and is inferior in temperature properties, and thus is easily magnetically saturated. Particularly, in a case where the soft ferrite is used for components of a high current circuit such as a current transformer or a choke coil having a possibility of DC superimposition, there are problems in that satisfactory properties cannot be obtained, the size of a component becomes larger, the magnetic properties with respect to the temperature are greatly changes, and the components are inferior in the temperature properties. In addition, an Fe-based amorphous alloy representing Fe—Si—B based alloys has problems in that a B—H curve having good linearity is not exhibited even with heat treatment performed in magnetic field, and that in a case of being excited at audio frequency to be used, the noise of components is large. Further, a Co-based amorphous alloy has the following problems. That is, the Co-based amorphous alloy has a low saturation magnetic flux density of 1 T or less, and thus the size of the component becomes larger. In addition, the Co-based amorphous alloy is thermally unstable, and thus the change over time is large at the time of temperature rise. Furthermore, the raw materials of the Co-based amorphous ally are expensive.

It has been known that an Fe-based nanocrystal alloy ribbon exhibiting more excellent soft magnetic properties than those of the above-described soft magnetic materials is suitable for a magnetic core material for pulse power application such as an earth leakage breaker, a current sensor, a current transformer, a common mode choke coil, a high frequency transformer, and an accelerator. As a representative compositional system of the Fe-based nanocrystal alloy ribbon, Fe—Cu—(Nb, Ti, Zr, Hf, Mo, W, Ta)—Si—B-based alloys and Fe—Cu—(Nb, Ti, Zr, Hf, Mo, W, Ta)—B-based alloys have been known (refer to PTLs 1 and 2).

These Fe-based nanocrystal alloy ribbons are typically produced by a method of quenching from a liquid phase to produce an amorphous alloy ribbon, processing the amorphous alloy ribbon in a magnetic core shape as necessary, and then performing microcrystallization by heat treatment. As the method of quenching from a liquid phase to produce an alloy ribbon, a single roll method, a double roll method, a centrifugal quenching method, and the like are known, and in a case of mass production of super rapidly quenched alloy ribbons, the single roll method is mainly used. The Fe-based nanocrystal alloy is obtained by performing the microcrystallization on the amorphous alloy produced by the above-described method, and it has been known that the alloy exhibits a high saturation magnetic flux density and excellent soft magnetic properties which are equivalent to the Fe-based amorphous alloy, is less likely to change over time as compared with the amorphous alloy, and is excellent in the temperature properties.

In addition, an Fe-based nanocrystal alloy ribbon of Fe—Si—B—Cu-based or Fe—Si—B—P—Cu-based alloys, which exhibits high magnetic flux density, so as to respond to the recent demand for high energy density has been known (PTLs 3 and 4).

In recent years, a material exhibiting a B—H curve which is excellent in constant permeability having slightly low permeability such that a material is not magnetically saturated has been used as a highly-demanded magnetic core material such as a choke coil which is used in a DC superimposition state or an asymmetric AC excitation state, and a current transformer (CT) in which an AC current having an asymmetric waveform such as a half sine alternating current flows into a coil. In such applications, a material having the constant permeability of 6000 or less is typically used; however, a material exhibiting the constant permeability approximately in a range of 1000 to 3000 has been used in a case of being used as a current transformer (CT) which is suitable for detection for an AC current having an asymmetric waveform such as a sinusoidal alternating current, or detection for an AC current on which a DC current is superimposed. Particularly, in accordance with the requirement of accurate measurement of an asymmetrical current waveform or a distorted current waveform (asymmetric current waveform), a magnetic material capable of accurately measuring electric energy from the asymmetric current waveform has been demanded. It has been reported that as a magnetic material satisfying such a requirement, a material which exhibits a low residual magnetic flux density, low hysteresis, and good linearity of B—H curve is used, and a magnetic core (iron core) formed of an Fe-based soft magnetic alloy ribbon containing Co or Ni in which the heat treatment in the magnetic field is performed exhibits suitable properties as the aforementioned material (PTL 5, 6, and 7).

CITATION LIST

Patent Literature

[PTL 1] JP-A-64-79342
[PTL 2] JP-A-1-242755
[PTL 3] JP-A-2008-231534
[PTL 4] WO 2008/133302
[PTL 5] WO 2006/064920
[PTL 6] WO 2004/088681
[PTL 7] JP-A-2013-243370

SUMMARY OF INVENTION

Technical Problem

In a case where the conventional Fe-based soft magnetic alloy ribbon containing Co or Ni is used for a wound magnetic core having a small diameter, it is difficult to induce properly aligned magnetic anisotropy in one direction even through the heat treatment in the magnetic field is performed. As the diameter of the wound magnetic core becomes smaller, the ribbon is wound and the curvature thereof becomes larger, and thus restraints are caused by contact between ribbons. Thus, due to the aforementioned curvature, stress tends to remain on the surface of the ribbon after the heat treatment, and due to the restraints, free shrinkage is hindered by cooling at the final stage of the heat treatment and the stress tends to occur. For this reason, the magnetic anisotropy occurs due to a stress-magnetostriction effect, it is difficult to induce properly uniaxial induced magnetic anisotropy even through the heat treatment in the magnetic field which is performed for applying the magnetic field. From the above-described reasons, the conventional ribbon and the magnetic core formed by using the ribbon have problems in that a B—H curve which has small hysteresis with good linearity, and has non-steep and flat slope as a whole cannot be realized, and a residual magnetic flux density Br is high, the hysteresis of the B—H curve becomes larger (coercive force Hc becomes larger), and incremental permeability is greatly changed with respect to a superimposed magnetic field.

Solution to Problem

The present inventors have found that it is possible to solve the above-described problems with a ribbon which is formed of an Fe-based soft magnetic alloy and has a specific cross-sectional structure is excellent in the linearity of a B—H curve, and exhibits excellent properties of a low residual magnetic flux density Br, small hysteresis of the B—H curve (small coercive force Hc), and small change of the incremental permeability with respect to a superimposed magnetic field, and have conceived the present invention.

That is, the present invention relates to an Fe-based soft magnetic alloy ribbon formed of an Fe-based soft magnetic alloy including Co of 5 atomic % or more to 20 atomic % or less and Cu of 0.5 atomic % or more to 1.5 atomic % or less. The Fe-based soft magnetic alloy ribbon includes a Cu-concentrated region present directly below a surface of the ribbon, and a Co-concentrated region present directly below the Cu-concentrated region.

In the present invention, the Fe-based soft magnetic alloy may further include Ni which is of 15 atomic % or less, and satisfies a relationship of $0.5 \leq c/b \leq 2.5$, wherein b is an amount of Co and c is an amount of Ni. The Fe-based soft magnetic alloy may further includes Si of 8 atomic % or more and 17 atomic % or less, B of 5 atomic % or more and 12 atomic % or less, and M of 1.7 atomic % or more and 5 atomic % or less, wherein M is at least one element selected from the group consisting of Mo, Nb, Ta, W, and V.

Moreover, the present invention is a magnetic core comprising the Fe-based soft magnetic alloy ribbon described above. Still further the magnetic core may be used for a current transformer for detection of a half sine alternating current.

Advantageous Effects of Invention

The Fe-based soft magnetic alloy ribbon of the present invention is a soft magnetic material which is excellent in the linearity of the B—H curve, and has the low residual magnetic flux density Br, small hysteresis of the B—H curve (small coercive force Hc), and small change of the incremental permeability with respect to the superimposed magnetic field, and thus it is possible to provide a high-performance magnetic core used for various magnetic components by using the Fe-based soft magnetic alloy ribbon.

DESCRIPTION OF EMBODIMENTS

Figure 1:
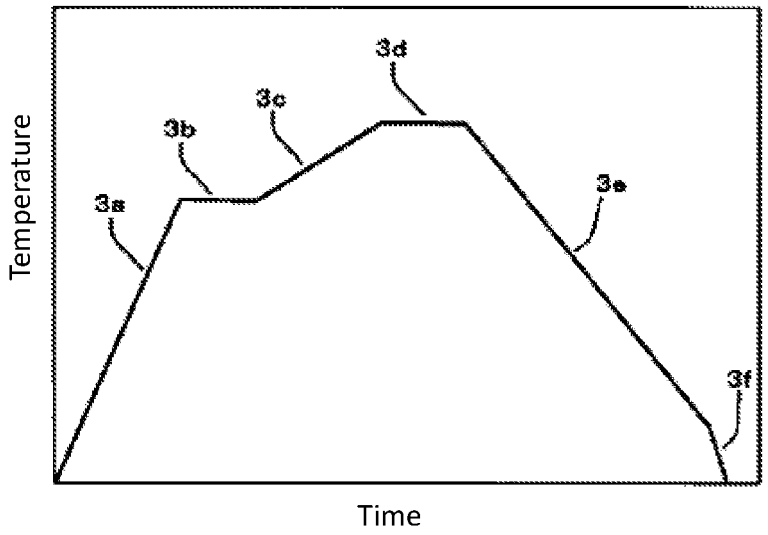
FIG. 1 is a diagram illustrating an example of a heat treatment pattern which is preferable for a ribbon according to the present invention.

The present invention has an important feature in that a ribbon has a particular cross-sectional structure, that is, a cross-sectional structure in which a Cu-concentrated region is present directly below a surface of the ribbon, and a Co-concentrated region is present directly below the Cu-concentrated region. When an Fe-based soft magnetic alloy ribbon containing a specific component which is subjected to a heat treatment in the magnetic field has the above-described cross-sectional structure, the ribbon is excellent in the linearity of a B—H curve, and exhibits excellent properties of a low residual magnetic flux density Br, small hysteresis of the B—H curve (small coercive force Hc), and small change of the incremental permeability with respect to a superimposed magnetic field. Similarly, a magnetic core formed by using the aforementioned ribbon also exhibits the excellent properties. For example, in a case where the present invention is applied to a wound magnetic core having a small diameter, it is easy to induce the induced magnetic anisotropy of the surface of the ribbon, it is possible to increase the magnetic anisotropy due to a stress-magnetostriction effect occurring in the Co-concentrated region close to the surface of the ribbon by the heat treatment in the magnetic field, and it is possible to suppress variation of the magnetic anisotropy.

The Fe-based soft magnetic alloy ribbon of the present invention has a specific component. Specifically, the Fe-based soft magnetic alloy ribbon contains Co of 20 atomic % or less and Cu of 0.5 atomic % or more and 1.5 atomic % or less.

Co: 5 Atomic % or More and 20 Atomic % or Less

Co (cobalt) has an effect of increasing the induced magnetic anisotropy, contributes to low permeability, is essential element in the Fe-based soft magnetic alloy ribbon of the present invention, and is set to be of 5 atomic % or more and 20 atomic % or less. In a case where the Co amount is less than 5 atomic %, a Co-concentrated region is not clearly generated in some cases. In addition, when the Co amount is excessively small, the effect of increasing the induced magnetic anisotropy by Co is deteriorated, the permeability does not become smaller, and the linearity of a B—H loop is also deteriorated in some cases. In a case where the Co amount is greater than 20 atomic %, undesirable properties such as large coercive force Hc of the ribbon and large hysteresis are exhibited. Since the aforementioned effect obtained by Co can be also obtained by Ni some extent, it is possible to substitute a portion of Co with Ni.

Cu: 0.5 Atomic % or More and 1.5 Atomic % or Less

Cu (copper) is an essential element in the Fe-based soft magnetic alloy ribbon of the present invention, and the amount thereof is set to be of 0.5 atomic % or more and 1.5 atomic % or less. When the Cu amount is 0.5 atomic % or more, a Cu cluster acts as a heterogeneous nucleation site at the time of crystallization in the producing of the ribbon, and thus it is possible to obtain a ribbon having a uniform and fine structure. In a case where the Cu amount is less than 0.5 atomic %, a number density of Cu clusters is not sufficient, and a crystal grain structure which is found in the cross-sectional structure of the ribbon becomes a structure in which fine crystals and slightly coarse crystals are mixed. Such a ribbon has large coercive force Hc due to ununiform particle sizes and particle distributions in the structure, and thus is not preferable. On the other hand, in a case where the Cu amount is greater than 1.5 atomic %, since the ribbon is remarkably embrittled, it is difficult to wind the ribbon so that the ribbon cannot be easily produced, and thus, the aforementioned Cu amount is not preferable. The Cu amount is preferably of 0.7 atomic % or more and 1.2 atomic % or less in order to easily produce the ribbon by suppressing the embrittlement.

In addition, in a case where the ribbon contains a proper amount of Cu, a number of the Cu clusters are formed in the ribbon during the heat treatment, and the Cu clusters act as the heterogeneous nucleation site, and thus it is effective for uniformity and miniaturization of a bcc (body-centered cubic) crystal grain structure. In such a ribbon, an average crystal grain size of the bcc crystal grain which is formed in a state of being dispersed in an amorphous parent phase is equal to or less than 30 nm, and in a case where the average crystal grain size is in a range of 5 to 20 nm, it is possible to obtain a particularly excellent soft magnetic properties. In addition, such a ribbon has a volume fraction of a crystalline phase which is equal to or greater than 50%, and the typical volume fraction of crystalline phase is approximately in a range of 60% to 80%.

In the Fe-based soft magnetic alloy ribbon of the present invention, Cu hardly forms a solid solution in Fe while forming a number of Cu clusters in the above-described ribbon, and thus tends to segregate. For this reason, Cu segregates in the vicinity of a boundary with an alloy layer of the inside of the ribbon and an oxide layer of the surface of the ribbon, and thus a Cu-concentrated region is easily formed. In a case where the ribbon contains proper amounts of Cu and Co, it is possible to cause the Co-concentrated region which is formed in the ribbon to be formed directly below the Cu-concentrated region under the conditions of the heat treatment.

In a case where the Cu-concentrated region is present directly below the surface of the ribbon, and the Co-concentrated region is present directly below the Cu-concentrated region, the ribbon is subjected to the heat treatment in the magnetic field so as to increase the induced magnetic anisotropy of the concentrated regions of Cu and Co. With this, action effects are exhibited such that the anisotropic dispersion due to the stress, which is generated at the time of producing and processing of the ribbon, and still remains after the heat treatment, is decreased, and an adverse effect such as variation of the magnetic anisotropy (easy magnetization direction) caused by the stress-magnetostriction effect is decreased. As a result, even in a case where such a ribbon is used for the wound magnetic core, it is possible to realize that the linearity of the B—H curve is improved, the residual magnetic flux density Br is low, the hysteresis of the B—H curve is small (coercive force Hc is small), and the change of the permeability with respect to exciting magnetic field is small.

In the cross-sectional structure of the Fe-based soft magnetic alloy ribbon of the present invention, a peak concentration of the Co-concentrated region is preferably 1.02 times or more and 1.20 times or less with respect to an average value of the Co concentration which is measured in a depth from the surface of the ribbon in a range of 0.1 μm to 0.2 μm. In a case where the peak concentration of the Co-concentrated region is less than 1.02 times the average value, an improvement effect of the above-described properties may be insufficient. In addition, in a case where the peak concentration of the Co-concentrated region is greater than 1.20 times the average value, the change in the induced magnetic anisotropy is greatly affected by the change of the Co concentration of the surface of the ribbon, and thus a B—H loop shape or the like is deteriorated in some cases. Note that, a region having the Co concentration lower than the average value may be present directly below the above-described Co-concentrated region. Such a Co concentration and a Cu concentration can be indicated as a Co content and a Cu content in the thickness direction (depth direction) of the ribbon which are measured by using a glow discharge-optical emission spectroscopy (GD-OES).

In the same way, a peak concentration of the Cu-concentrated region is preferably 2 times or more and 12 times or less with respect to an average value of the Cu concentration which is measured in a depth from the surface of the ribbon in a range of 0.1 μm to 0.2 μm. In a case where the peak concentration of the Cu-concentrated region is less than 2 times the average value, an improvement effect of the above-described properties may be insufficient. In addition, in a case where the peak concentration of the Cu-concentrated region is greater than 12 times the average value, the change in the induced magnetic anisotropy is greatly affected by the change of the Cu concentration of the surface of the ribbon, and thus a B—H loop shape or the like is deteriorated in some cases. Note that, a region having the Cu concentration lower than the average value may be present directly below the above-described Cu-concentrated region.

In the present invention, as a raw material, it is preferable to contain Ni which is cheaper than Co. For example, in a case where a portion of Co is substituted with Ni, it is possible to reduce raw material cost of the ribbon. Similar to the case of Co, Ni has an effect of increasing the induced magnetic anisotropy, and contributes to the low permeability. For example, if the addition amount (atomic %) of Ni with respect to Fe is the same as that of the Co, it is possible to increase the induced magnetic anisotropy and decrease the permeability as compared with Co. In addition, as the content ratio of Co or Ni with respect to Fe is increased, a melting point is decreased, and thus the ribbon can be produced by decreasing a casting temperature is decreased in accordance with the decrease in the melting point. For example, it becomes easier to produce the ribbon, and it is expected to improve the life span of a refractory material or the like.

In addition, when the ribbon contains a proper amount of Ni, it is possible to obtain the ribbon having preferred properties as described above as compared with a case where Ni is not contained. If such an Ni effect is used, it is possible to decrease the Co amount corresponding to the improvement of the properties by adding Ni, and thus it is possible to produce the ribbon, which has the same properties as those in a case of not containing Ni and not decreasing the amount of Co, at low cost. As such, the ribbon exhibiting the effect by the total amount of Co and Ni has substantially the same properties as those of the ribbon in which Ni is not contained and the Co amount is not decreased, and further reduction in the raw material cost can be expected.

However, in a case where the Ni amount contained in the ribbon is greater than 15 atomic %, it is easy to form a ferromagnetic compound phase in the heat treatment, and thus the coercive force Hc becomes remarkably larger, or the shape of the B—H curve is deteriorated in some cases. For this reason, the ribbon preferably contains Ni of 4 atomic % or more and 15 atomic % or less in terms of the optimization of the induced magnetic anisotropy and the coercive force Hc, reduction of the raw material cost, and expansion of a range of appropriate heat treatment conditions. As a result of increasing Ni amount by substituting a portion of Co contained in the ribbon with Ni, when the Co amount contained in the ribbon becomes excessively smaller, there are problems in that the Co-concentrated region required in the present invention is not generated, an adjustable range under the proper heat treatment conditions becomes smaller, and the surface tends to be easily crystallized at the time of producing the ribbon.

As described above, it is considered that there is a preferred relationship between Co and Ni. In the ribbon according to the present invention, in the case where a portion of Co is substituted with Ni, when the Co amount is set to be b atomic %, and the Ni amount is set to be c atomic % within the range in which the Ni amount is equal to or less than 15 atomic %, it is preferable to satisfy a relationship expressed by $0.5 \leq c/b \leq 2.5$. The Fe-based soft magnetic alloy ribbon satisfying the aforementioned relationship can have further preferred properties such as wide heat treatment temperature range and high magnetic flux density. When the c/b is greater than 2.5 by increasing the Ni amount with respect to the Co amount, a range of a second temperature region in a second heat treatment process described below becomes smaller and thus temperature control becomes difficult. When the c/b is less than 0.5, the aforementioned effect obtained by Ni is small.

In the Fe-based soft magnetic alloy ribbon containing the aforementioned Co and Ni, for example, the Fe-based soft magnetic alloy has a composition expressed by Composition formula: $Fe_{bal.}Co_bNi_cSi_yB_zM_aCu_x$, M is at least one element selected from the group consisting of Mo, Nb, Ta, W, and V, and b, c, y, z, a, and x are respectively atomic percent and satisfy each of the relationships expressed by $5 \leq b \leq 20$, $4 \leq c \leq 15$, $0.5 \leq c/b \leq 2.5$, $8 \leq y \leq 17$, $5 \leq z \leq 12$, $1.7 \leq a \leq 5$, and $0.5 \leq x \leq 1.5$. In a case of having such a composition, it is possible to produce the ribbon having wide width in a relatively easy way, and thus it is possible to efficiently mass-produce the ribbon having the above-described excellent properties.

When a molten metal containing Si is used, Si is helpful for forming an amorphous phase at the time of producing the ribbon. In addition, Si exhibits an effect of improving the soft magnetic properties by suppressing the coercive force Hc of the ribbon or the magnetic core formed by using the ribbon, an effect of changing magnetostriction, and an effect of improving the high frequency properties by increasing the resistivity.

In addition, when a molten metal containing B, B contributes to amorphization at the time of producing the ribbon. Further, when B is present in the amorphous parent phase around the crystal grains of the ribbon after the heat treatment, it contributes to the miniaturization of the crystal grain structure of the ribbon, and thus the coercive force Hc is suppressed, thereby realizing an effect of improving the soft magnetic properties.

In addition, when a molten metal containing M which is at least one element selected from the group consisting of Mo, Nb, Ta, W, and V, M contributes to the miniaturization of the crystal grain after the heat treatment of the ribbon.

Further, in the present invention, it is possible to use a molten metal containing Cr, Mn, Ti, Zr, Hf, P, Ge, Ga, Al, Sn, Ag, Au, Pt, Pd, Sc, and a white metal group element in order to improve the corrosion resistance of the ribbon and various magnetic properties, or facilitate the production of the ribbon, as necessary. In addition, examples of the impurities include elements of C, N, S, and O, and particularly, C is confirmed to be easy to mix. The mixing of these impurity elements is acceptable as long as it does not affect the soft magnetic properties and the production of the ribbon. The acceptable value is less than 1.0% by mass and preferably equal to or less than 0.5% by mass, based on the experience of the present inventors.

With the soft magnetic properties which are excellent in the above-described Fe-based soft magnetic alloy ribbon of the present invention, it is possible to obtain a magnetic core according to the present invention which is formed of the ribbon. The magnetic core according to the present invention is preferably used for, for example, a current transformer, a high current large capacity compatible choke coil, a high frequency transformer, and a pulse power core, and particularly, it is preferably used for a current transformer for detecting an alternating current, on which a DC component is superimposed, such as a distorted current of the half sine alternating current.

The magnetic core according to the present invention is produced as a wound magnetic core obtained by winding the Fe-based soft magnetic alloy ribbon in many cases, and is generally used being contained in a resin case so as to prevent the magnetic properties from being deteriorated by applying the stress to the magnetic core. In addition, as necessary, the surface of the ribbon is coated with powders such as alumina, silica, and magnesia, or an insulation coating film formed of alumina, silica, or magnesia coats the surface of the ribbon in some cases in order to bring the adjacent ribbons into an insulated state.

Next, a treating method of obtaining an Fe-based soft magnetic alloy ribbon or a magnetic core formed of the aforementioned ribbon such that the Fe-based soft magnetic alloy ribbon or the magnetic core have the predetermined soft magnetic properties.

The ribbon can be produced by using a method of emitting a molten metal made by melting a material having a desired alloy composition in a crucible or the like on to the surface of a copper alloy cooling roll rotating at a peripheral velocity in a range of 20 m/s to 40 m/s from a slit provided in a nozzle of the crucible, and then quenching the emitted molten metal. The ribbon produced by such a method which has an amorphous phase as a main phase can be subjected to slit processing, cutting processing, and punching processing as necessary. A typical thickness (through-thickness) of the ribbon is in a range of 5 μm to 50 μm, and a mass-producible width is in a range of 0.5 mm to several hundreds mm. In addition, it is possible to produce a magnetic core by winding the ribbon which can be produced by using the above-described method.

The ribbon or the magnetic core produced by using the above-described method has predetermined soft magnetic properties, for example, through a first heat treatment process, a second heat treatment process, and a third heat treatment process which will be described below. In this case, it is preferable to perform all of the heat treatment processes while applying a strong magnetic field to the ribbon or the magnetic core so as to be magnetically saturated at a temperature in a range of at least 200° C. to 600° C. Note that, when the applying magnetic field is weak, the magnetization directions of the alloy are not perfectly aligned in the magnetic field application direction, and thus regions having different easy magnetization directions are formed in the ribbon or the magnetic core, and the shape of the B—H curve is deteriorated in some cases. The applying magnetic field is generally a DC magnetic field, and it is also possible to apply an AC magnetic field or a pulsed magnetic field repetitively. It is possible to adjust the typical strength of the applying magnetic field in accordance with the formation of the ribbon or the magnetic core, and in a case where the DC magnetic field is applied in the width direction of the ribbon or the height direction of the magnetic core, the strength of the magnetic field is preferably in a range of 80 kA/m to 500 kA/m.

The first heat treatment process is a heat treatment process of increasing the temperature of the ribbon or the magnetic core up to a first temperature region in a range of 350° C. to 460° C. at a rate of 1° C./min or more and 20° C./min or less, and then retaining the temperature in the first temperature region for 15 minutes to 120 minutes. The main purpose of the first heat treatment process is to make the internal temperature of the ribbon or the magnetic core uniform so as to prompt the generation of the Cu-concentrated region positioned directly below the surface of the ribbon. Note that, in the second heat treatment process described below, a proper setting temperature of the first temperature region and a retention time contribute to the prompting of the generation of the Co-concentrated region positioned directly below the Cu-concentrated region.

The first temperature region within which the temperature is retained in the first heat treatment process is preferably in a range of 350° C. to 460° C. In a case where the temperature is lower than 350° C., a residual stress of the ribbon or the magnetic core is difficult to be released, and in a case where the temperature is higher than 460° C., the coercive force Hc is likely to be large. The heating rate is preferably in a range of 1° C./min to 20° C./min. In a case where the heating rate is less than 1° C./min, the productivity is deteriorated, and in a case where the heating rate is greater than 20° C./min, uniformity of the internal temperature of the ribbon or the magnetic core and generation of the Cu-concentrated region are insufficient, which tends to cause a variation in the magnetic properties. The retention time in the first temperature region is preferably in a range of 15 minutes to 120 minutes. In a case where the retention time is shorter than 15 minutes, the internal temperature of the ribbon or the magnetic core becomes uniform, which tends to cause a variation in the magnetic properties, and in a case where the retention time is longer than 120 minutes, the productivity is deteriorated.

The second heat treatment process is followed by the first heat treatment process, and is a heat treatment process of increasing the temperature of the ribbon or the magnetic core up to a second temperature region in a range of 500° C. to 600° C. at a rate in a range of 0.3° C./min to 5° C./min, and then maintaining the temperature in the second temperature region for 15 minutes to 120 minutes. The main purpose of the second heat treatment process is to generate a uniform nanocrystal grain structure and prompt the generation of the Cu-concentrated region positioned directly below the surface of the ribbon and the Co-concentrated region positioned directly below the Cu-concentrated region while maintaining the internal temperature of the ribbon or the magnetic core in a uniform state and suppressing the temperature rise due to the heat generation of crystallization in which nanocrystal grains are precipitated in the amorphous parent phase of the ribbon.

The second temperature region within which the temperature is retained in the second heat treatment process is preferably in a range of 500° C. to 600° C. In a case where the temperature is lower than 500° C., the ratio of the amorphous parent phase becomes excessive and thus it is likely that the linearity of the B—H curve is deteriorated and the coercive force Hc is likely to be large, and in a case where the temperature is higher than 600° C., the coercive force Hc is likely to be large. The heating rate is preferably in a range of 0.3° C./min to 5° C./min, in a case where the heating rate is less than 0.3° C./min, the productivity is deteriorated, and in a case where the heating rate is greater than 5° C./min, the temperature rise due to the heat generation of crystallization becomes larger, and it is likely that the nanocrystal grains are not uniform and the coercive force Hc is large. In addition, in a case where the heating rate is excessively large, the generation of the Co-concentrated region does not proceed in some cases. The retention time in the second temperature region is preferably in a range of 15 minutes to 120 minutes. In a case where the retention time is shorter than 15 minutes, a temperature difference in the ribbon or the magnetic core becomes larger, which causes deterioration of the linearity of the B—H loop and the variation in the magnetic properties, and in a case where the retention time is longer than 120 minutes, the productivity is deteriorated.

The third heat treatment process is followed by the second heat treatment process, and is a cooling heat treatment process of decreasing the temperature of the ribbon or the magnetic core down to a third temperature region equal to or lower than 200° C. at a rate in a range of 1° C./min to 20° C./min, without deteriorating the magnetic anisotropy induced from the first and second heat treatment processes. The cooling rate is preferably in a range of 1° C./min to 20° C./min. In a case where the cooling rate is lower than 1° C./min, the productivity is deteriorated and thus the aforementioned cooling rate is not satisfactory, and in a case where the cooling rate higher than 20° C./min, the linearity of B—H curve is likely to be deteriorated due to the stress caused by contraction of the ribbon. Note that, the magnetic field in the third heat treatment process is preferably applied until the temperature is equal to or lower than 200° C. so as not to deteriorate the uniaxial induced magnetic anisotropy in the ribbon or the magnetic core. For example, in a case where the application of the magnetic field is stopped in a temperature range which is higher than 200° C., the B—H loop shape is deteriorated, and the coercive force Hc is likely to be large.

Generally, the above-described first, second, and third heat treatment processes can be performed in an inert gas atmosphere or a nitrogen gas atmosphere. A dew point of ambient gas is preferably equal to or lower than −30° C., and is further preferably equal to or lower than −60° C. In a case where the dew point of ambient gas is higher than −30° C., a coarse crystal grain having a diameter of greater than 30 nm is generated on the surface of the ribbon, and thereby the coercive force Hc is likely to be large.

EXAMPLE

The Fe-based soft magnetic alloy ribbon according to the present invention and the magnetic core according to the present invention, which is formed of the ribbon, will be specifically described with reference to appropriate drawings. However, the scope of the present invention should not be limited to the exemplary embodiments described below.

Example 1

With a single roll method performed by using a Cu—Be alloy roll which rotates at a peripheral velocity of 30 m/s, and has an outer diameter of 280 mm, an Fe-based alloy ribbon having a width of 5 mm and an average thickness of 20.2 μm was produced by using a molten metal including, 11.1% of Co, 10.2%, of Ni, 11.0% of Si, 9.1% of B, 2.7% of Nb, 0.8% of Cu, by atomic percent, and a balance consisting of Fe and inevitable impurities. The ratio of Ni/Co in the aforementioned ribbon is approximately 0.92. Then, a magnetic core (a wound magnetic core) having the outer diameter of 19 mm and the inner diameter of 15 mm was produced by winding the produced ribbon. The heat treatment was performed in a nitrogen gas atmosphere with a heat treatment pattern illustrated in FIG. 1 while applying the magnetic field in the height direction of the produced wound magnetic core (the width direction of the ribbon) at 300 kA/m. The heat treatment includes: the above-described first heat treatment process (heating rate: 3.6° C./min in Process 3a, and retention temperature: 430° C. and retention time: 30 minutes in Process 3b); the second heat treatment process (heating rate: 2.2° C./min in Process 3c, and retention temperature: 560° C. and retention time: 30 minutes in Process 3d); the third heat treatment process (cooling rate: 2.7° C./min and a target temperature to be decreased: 170° C. in Process 3e); and Process 3f of performing air-cooling after reaching the target temperature to be decreased.

The Co concentration and the Cu concentration in the vicinity of the surface of the ribbon used for the magnetic core were measured by using the magnetic core after the heat treatment through the magnetic measurement and glow discharge-optical emission spectroscopy (GDOES). Note that, the GDOES was performed under the conditions such as an argon gas pressure of 600 Pa, an output of 35 W, a pulse mode, an anode diameter of φ2 mm, and a duty ratio of 0.25 by using a high-frequency glow discharge light emission surface analyzer (GD PROFILER 2) manufactured by HORIBA, Ltd. In addition, a sputter trace formed on a sample by the GDOES was measured by using a surface roughness meter so as to obtain a surface roughness value, the obtained surface roughness value was divided by the sputtering time of the GDOES, and then the resultant value is rate-converted so as to obtain an analysis depth. In addition, the ribbon was subjected to X-ray diffraction. From the result of the X-ray diffraction, it was confirmed that a fine crystal grain which mainly contains Fe having a bcc structure was formed in the ribbon, and an average grain size of the crystal grains was approximately 18 nm based on a half width of a diffraction peak.

Figure 2:
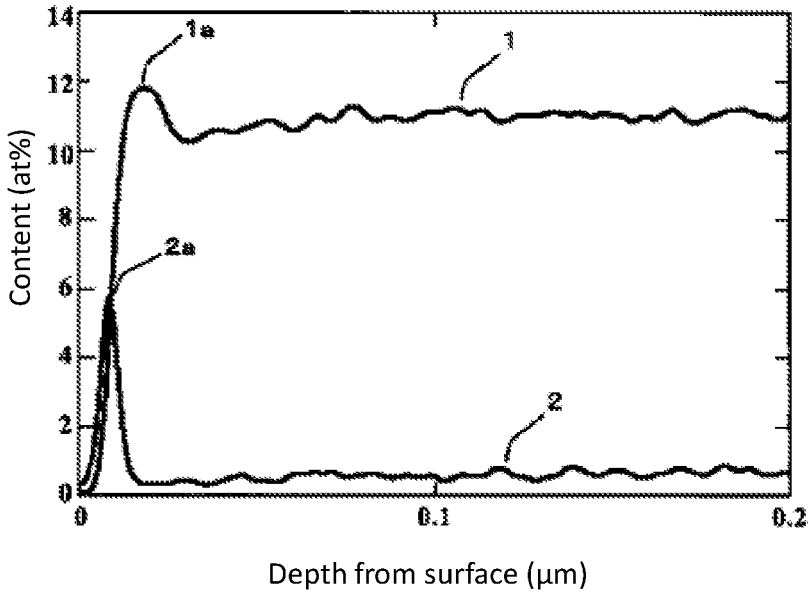
FIG. 2 is a diagram illustrating an example of a change of a Co amount and a Cu amount in a depth direction which are measured from a surface on the free surface side of the ribbon according to the present invention through GD-OES.

FIG. 2 illustrates a result of the analysis of Co (curve 1 in FIG. 2) and Cu (curve 2 in FIG. 2) on the free surface side of the ribbon through the GDOES. It is confirmed that the Cu-concentrated region denoted by a steep peak 2*a* is present directly below the surface of the ribbon, and the Co-concentrated region denoted by a convex peak 1*a* is present directly below the Cu-concentrated region. Further, although not shown, similar to the case of the free surface side, it is confirmed from the result of the analysis of the ribbon on the roll contact surface side through the GDOES that Cu-concentrated region is present on the surface of the ribbon, and the Co-concentrated region is present directly below the Cu-concentrated region. Here, the concentration in the peak 1*a* of the Co-concentrated region was 11.8 atomic %, the average value of the Co concentration, which was measured in a depth from the surface of the ribbon in a range of 0.1 μm to 0.2 μm, was 11.1 atomic %, and the concentration in the peak 1*a* was 1.063 times the average value. In addition, the concentration in the peak 2*a* of the Cu-concentrated region was 5.9 atomic %, the average value of the Cu concentration which was measured in a depth from the surface of the ribbon in a range of 0.1 μm to 0.2 μm was 0.8 atomic %, and the concentration in the peak 2*a* was 7.375 times the average value.

Figure 3:
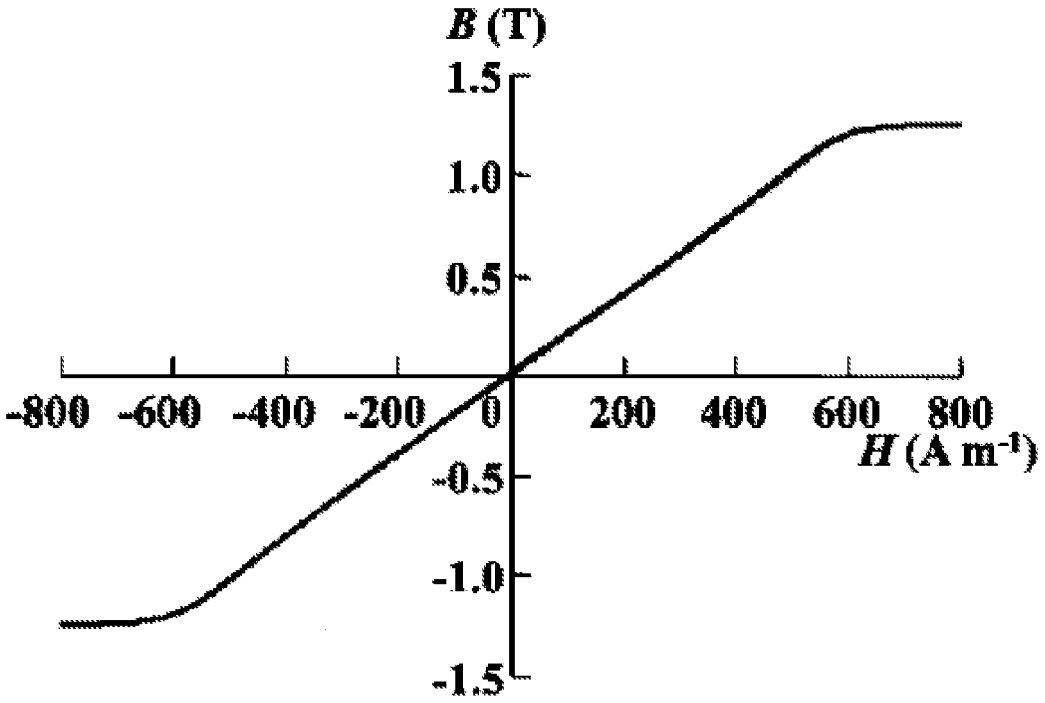
FIG. 3 is a diagram illustrating an example of a DC B—H curve of a magnetic core formed of the ribbon according to the present invention.

FIG. 3 illustrates a DC B—H curve of the ribbon. This DC B—H curve is a curve which has small hysteresis with good linearity, and has non-steep and flat slope as a whole, of which the residual magnetic flux density Br was 0.005 T, and the coercive force Hc was 2.5 A/m. In addition, the increment of relative permeability $\mu_{r\Delta}$ at 1 kHz was 1610 in a DC superimposed magnetic field of 0 A/m, and was 1660 in the DC superimposed magnetic field of at 200 A/m. With this, it was confirmed that the change of the permeability was small with respect to the magnetic field.

Comparative Example

Figure 4:
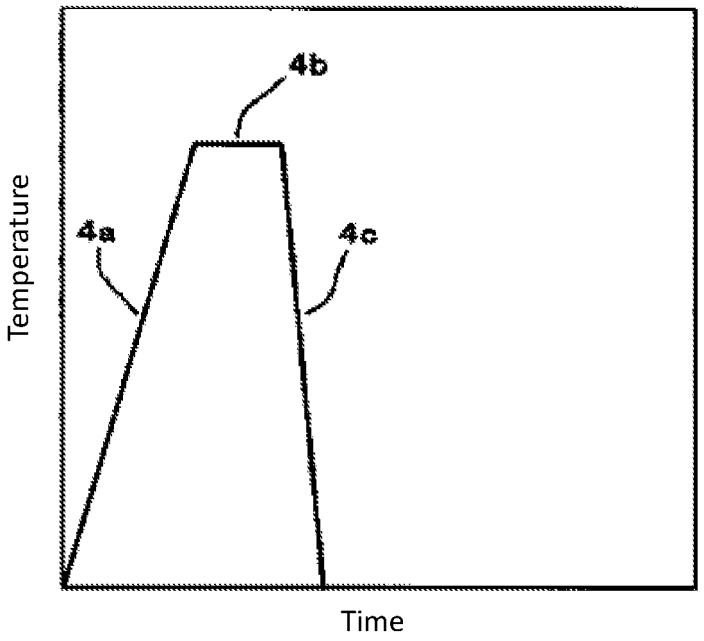
FIG. 4 is a diagram illustrating an example of a heat treatment pattern of a ribbon in Comparative Example.

With the same method as that used in Example 1, an Fe-based alloy ribbon having a width of 25 mm and an average thickness of 20.0 μm was produced by using a molten metal including, 3.1% of Co, 10.1% of Ni, 10.9% of Si, 8.9 of B %, 2.7% of Nb, 0.8% of Cu, by atomic percent, and a balance consisting of Fe and inevitable impurities. The ratio of Ni/Co in the aforementioned ribbon is approximately 3.26. Then, similar to Example 1, a magnetic core (a wound magnetic core) having the outer diameter of 19 mm and the inner diameter of 15 mm was produced by winding the produced ribbon, and the heat treatment was performed while applying the magnetic field in the height direction of the produced wound magnetic core (the width direction of the ribbon) at 300 kA/m. Here, in order to compare with Example 1, the heat treatment performed with the heat treatment pattern illustrated in FIG. 4 (heating rate: 3.6° C./min in Process 4a, retention temperature: 560° C. Process 4b, retention time: 5 minutes Process 4b, and temperature decreased down to room temperature at the cooling rate: 2.7° C./min in Process 4c) in a nitrogen gas atmosphere was intentionally employed. The reason for this is that when the heat treatment pattern does not include a retention process performed in the first temperature region in the above-described first heat treatment process and a temperature increasing process of the second heat treatment process, the Co-concentrated region is not clearly generated in the ribbon.

Figure 5:
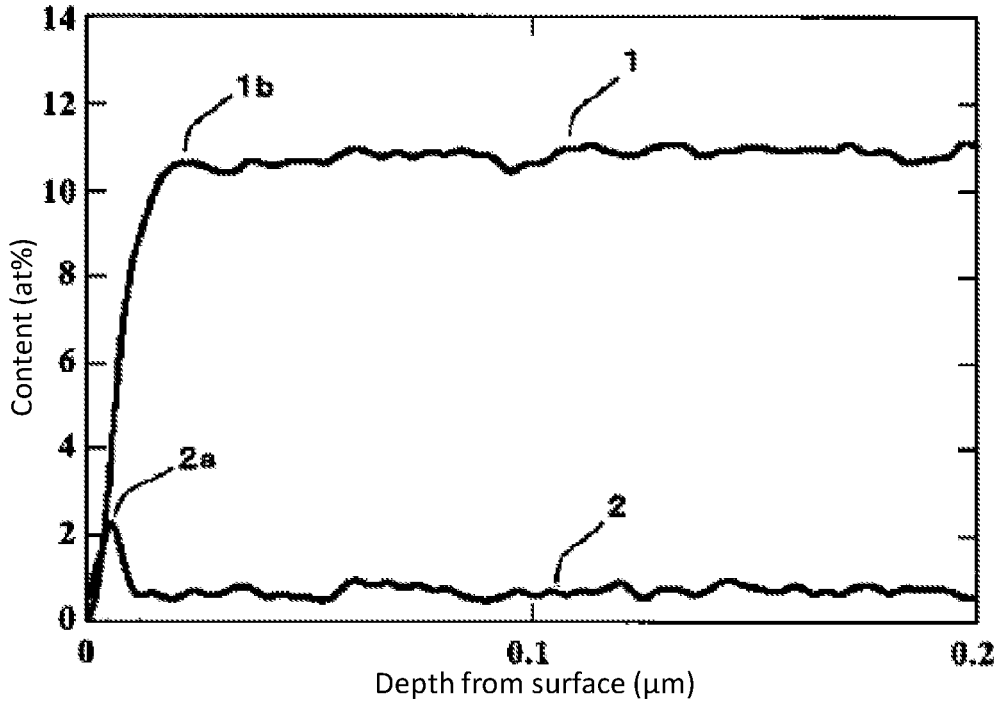
FIG. 5 is a diagram illustrating an example of a change of a Co amount and a Cu amount in a depth direction which are measured from a surface on the free surface side of the ribbon in Comparative Example through GD-OES.

FIG. 5 illustrates a result of the analysis of Co (curve 1 in FIG. 5) and Cu (curve 2 in FIG. 5) on the free surface side of the ribbon (Comparative Example) through the GDOES. The Cu-concentrated region denoted by a steep peak 2*a* is present directly below the surface of the ribbon; however, a clear peak was not indicated in a shoulder portion 1*b* of the Co curve 1 present directly below the Cu-concentrated region, and it was not possible to confirm the presence of the Co-concentrated region. When the change of the DC B—H curve and the permeability with respect to the DC superimposed magnetic field were confirmed by using the wound magnetic core (Comparative Example) formed of the aforementioned ribbon, the residual magnetic flux density Br was 0.04 T, and the coercive force Hc was 7.2 A/m. In addition, the increment of relative permeability $\mu_{r\Delta}$ at 1 kHz was 2190 in the DC superimposed magnetic field of 0 A/m, and was 2420 in the DC superimposed magnetic field of 200 A/m. With this, it was confirmed that in the case of Comparative Example, the change of $\mu_{r\Delta}$ with respect to the residual magnetic flux density Br, the coercive force Hc, and the DC superimposed magnetic field, and the change of $\mu_{r\Delta}$ with respect to the hysteresis and the DC superimposed magnetic field were large as compared with Example 1.

magnetic field of 200 A/m. Note that, in all of the ribbons in Examples of the present invention indicated in Nos. 1 to 7 and Comparative Examples indicated in Nos. 8 to 10, the Cu-concentrated region was confirmed to be present directly below the surface of the ribbon. In addition, in all Examples of the present invention indicated in Nos. 1 to 7, the peak value of the Co concentration was preferably in a range of 1.02 times to 1.20 times the average value of the Co concentration which is measured in a depth from the surface of the ribbon in a range of 0.1 μm to 0.2 μm.

TABLE 1

| | | Heat treatment conditions | | | | | | | Magnetic properties | | | Co-concentrated region | |
|---|---|---|---|---|---|---|---|---|---|---|---|---|---|
| No. | | HR1 ° C./min | Ta1 ° C. | t1 min | HR2 ° C./min | Ta2 ° C. | t2 min | CR3 ° C./min | Br T | Hc A/m | $\frac{\mu r\ \Delta 200}{\mu r\ \Delta 0}$ | Presence/ absence | $\frac{\text{Peak value}}{\text{Average value}}$ |
| Examples of the present invention | 1 | 3.7 | 435 | 30 | 2.1 | 540 | 30 | 2.9 | 0.006 | 2.6 | 1.04 | Presence | 1.065 |
| | 2 | 1.0 | 440 | 40 | 2.8 | 550 | 25 | 5.3 | 0.008 | 3.2 | 1.08 | Presence | 1.067 |
| | 3 | 2.8 | 460 | 80 | 1.5 | 560 | 20 | 11.5 | 0.007 | 3.0 | 1.05 | Presence | 1.089 |
| | 4 | 5.9 | 350 | 15 | 5.0 | 580 | 15 | 20.0 | 0.009 | 3.8 | 1.10 | Presence | 1.042 |
| | 5 | 14.3 | 390 | 20 | 2.3 | 530 | 60 | 3.2 | 0.006 | 2.7 | 1.04 | Presence | 1.061 |
| | 6 | 18.9 | 420 | 120 | 0.3 | 500 | 120 | 1.0 | 0.008 | 3.2 | 1.08 | Presence | 1.123 |
| | 7 | 20.0 | 450 | 60 | 0.8 | 520 | 100 | 1.8 | 0.007 | 2.8 | 1.05 | Presence | 1.158 |
| Comparative Examples | 8 | 2.1 | 50 | 5 | 42.0 | 520 | 4 | 31.1 | 0.015 | 7.8 | 1.22 | Absence | — |
| | 9 | 4.2 | 100 | 30 | 45.2 | 480 | 15 | 34.8 | 0.012 | 7.5 | 1.24 | Absence | — |
| | 10 | 5.8 | 150 | 60 | 25.2 | 490 | 10 | 24.9 | 0.017 | 8.0 | 1.23 | Absence | — |

Example 2

With the same method as that used in Example 1, an Fe-based alloy ribbon having a width of 10 mm and an average thickness of 18.3 μm was produced by using a molten metal including, 9.2% of Co, 11.9%, of Ni, 10.9% of Si, 9.1% of B, 2.7% of Nb, 0.8% of Cu, by atomic percent, and a balance consisting of Fe and inevitable impurities. The ratio of Ni/Co in the aforementioned ribbon is approximately 1.29. Then, a plurality of magnetic cores (wound magnetic cores) having the outer diameter of 24 mm, and the inner diameter of 18 mm were produced by winding the produced ribbon. The heat treatment was performed in a nitrogen gas atmosphere by a heat treatment pattern illustrated in FIG. 6 while applying the magnetic field in the height direction of the produced wound magnetic core (the width direction of the ribbon) at 320 kA/m. The heat treatment includes the above-described first heat treatment process (heating rate HR1, retention temperature Ta1, and retention time t1 indicated in Table 1); the second heat treatment process (heating rate HR2, retention temperature Ta2, and retention time t2 indicated in Table 1); the third heat treatment process (cooling rate CR3 indicated in Table 1 and target temperature to be decreased: 190° C.); and Process 5a of performing air-cooling after reaching the target temperature to be decreased.

Figure 6:
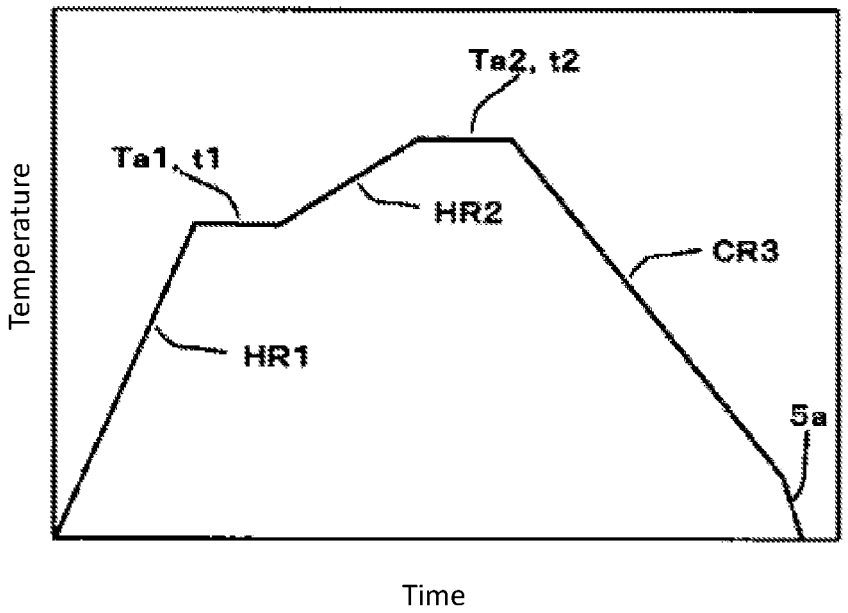
FIG. 6 is a diagram illustrating a heat treatment pattern used in Example 2.

An experiment using the wound magnetic core with the heat treatment pattern illustrated in FIG. 6 was carried out under the heat treatment conditions indicated in Table 1, and the results are indicated in Table 1 as follows: the presence of the Co-concentrated region directly below the Cu-concentrated region through the GDOES, the residual magnetic flux density Br, the coercive force Hc, the increment of relative permeability $\mu r_{\Delta 0}$ at 1 kHz and in the DC superimposed magnetic field of 0 A/m, and the increment of relative permeability $\mu r_{\Delta 200}$ at 1 kHz and in the DC superimposed In a case of the magnetic cores formed of the Fe-based soft magnetic alloy ribbons according to the present invention in which the Cu-concentrated region is present directly below the surface of the ribbon, and the Co-concentrated region is clearly present directly below the Cu-concentrated region (Examples of the present invention indicated in Nos. 1 to 7), the residual magnetic flux density Br, the coercive force Hc, and the change of the increment of relative permeability $\mu_{r\Delta}$ with respect to the magnetic field are smaller than the magnetic cores in Comparative Examples indicated in Nos. 8 to 10. In contrast, in a case of the magnetic cores formed of the Fe-based soft magnetic alloy ribbons in which even when the Cu-concentrated region is present directly below the surface of the ribbon, the clear Co-concentrated region is not present directly below the Cu-concentrated region, the residual magnetic flux density Br, the coercive force Hc, and the change of the increment of relative permeability $\mu_{r\Delta}$ with respect to the magnetic field are large. As described above, it is considered that the reason for this is because the magnetic core formed of the Fe-based soft magnetic alloy ribbon according to the present invention includes the DC B—H curve which has small hysteresis with good linearity, and has non-steep and flat slope as a whole.

Example 3

With the same method as that used in Example 1, an Fe-based alloy ribbon which has a composition (atomic %) indicated in Table 2, and has a width of 5 mm and an average thickness in a range of 18.0 μm to 20.3 μm was produced. Then, a magnetic core (a wound magnetic core) having the outer diameter of 19 mm and the inner diameter of 15 mm was produced by winding the produced ribbon. Similar to Example 1, after performing the heat treatment with the heat treatment pattern illustrated in FIG. 1, the analysis of the free surface side of the ribbon through the GDOES, and the measurement of the DC B—H curve and the increment of relative permeability $\mu_{r\Delta}$ were performed.

Table 2 indicates the presence of the Co-concentrated region directly below the Cu-concentrated region through the GDOES, the residual magnetic flux density Br, the coercive force Hc, the increment of relative permeability $\mu r_{\Delta 0}$ at 1 kHz and in the DC superimposed magnetic field of 0 A/m, and the increment of relative permeability $\mu r_{\Delta 200}$ at 1 kHz and in the DC superimposed magnetic field of 200 A/m. Note that, in all of the ribbons in Examples of the present invention indicated in Nos. 11 to 25 and Comparative Examples indicated in Nos. 26 to 29, the Cu-concentrated region was confirmed to be present directly below the surface of the ribbon. In addition, in all of Examples of the present invention indicated in Nos. 12 to 25 except for Example of the present invention indicated in No. 11 with the slightly large coercive force Hc of 3.9 A/m, the peak value of the Co concentration was preferably in a range of 1.02 times to 1.20 times the average value of the Co concentration which is measured in a depth from the surface of the ribbon in a range of 0.1 μm to 0.2 μm.

which more than 20 atomic % of Co was contained, the residual magnetic flux density Br and the coercive force Hc were likely to be large, and the change of the increment of relative permeability $\mu_{r\Delta}$ with respect to the magnetic field was also large. Further, in Comparative Example illustrated in Nos. 26 and 27 in which Co was not contained, and Comparative Example indicated in No. 28 in which 0.5 atomic % of small amount of Co was contained, all of the magnetic properties were great as compared with all Examples of the present invention indicated in Nos. 11 to 25.

As described above, it was confirmed that the Fe-based soft magnetic alloy ribbon according to the present invention in which the Cu-concentrated region is present directly below the surface of the ribbon, and the Co-concentrated region is present directly below the Cu-concentrated region, and the magnetic core formed of the aforementioned ribbon have excellent soft magnetic properties.

TABLE 2

| | | | Magnetic properties | | | Co-concentrated region | |
|---|---|---|---|---|---|---|---|
| No. | Composition (atomic %) | Ni/Co | Br T | Hc A/m | $\frac{\mu r\ \Delta 200}{\mu r\ \Delta 0}$ | Presence/ absence | $\frac{\text{Peak value}}{\text{Average value}}$ |
| Examples of the present invention | 11 $Fe_{bal.}Co_{20.0}Ni_{10.0}Si_{11.3}B_{9.1}Nb_{2.9}Cu_{0.5}$ | 0.50 | 0.009 | 3.9 | 1.09 | Presence | 1.201 |
| | 12 $Fe_{bal.}Co_{5.0}Ni_{12.5}Si_{11.1}B_{9.2}Nb_{2.8}Cu_{0.9}$ | 2.50 | 0.007 | 2.8 | 1.05 | Presence | 1.020 |
| | 13 $Fe_{bal.}Co_{8.0}Ni_{4.0}Si_{11.1}B_{9.2}Nb_{2.8}Cu_{0.9}$ | 0.50 | 0.008 | 2.9 | 1.06 | Presence | 1.052 |
| | 14 $Fe_{bal.}Co_{9.2}Ni_{11.9}Si_{11.1}B_{9.2}Nb_{2.7}Cu_{0.9}$ | 1.29 | 0.008 | 3.1 | 1.08 | Presence | 1.063 |
| | 15 $Fe_{bal.}Co_{10.5}Ni_{11.1}Si_{8.0}B_{12.0}Nb_{2.9}Cu_{0.9}$ | 1.06 | 0.004 | 1.8 | 1.03 | Presence | 1.060 |
| | 16 $Fe_{bal.}Co_{8.3}Ni_{12.9}Si_{17.0}B_{5.0}Nb_{1.7}Cu_{0.9}$ | 1.55 | 0.006 | 2.5 | 1.04 | Presence | 1.054 |
| | 17 $Fe_{bal.}Co_{11.1}Ni_{10.0}Si_{10.8}B_{9.4}Nb_{5.0}Cu_{0.9}$ | 0.90 | 0.007 | 2.7 | 1.05 | Presence | 1.092 |
| | 18 $Fe_{bal.}Co_{11.2}Ni_{9.9}Si_{11.1}B_{9.2}Nb_{2.7}Cu_{0.8}Mn_{0.5}$ | 0.88 | 0.003 | 1.7 | 1.03 | Presence | 1.091 |
| | 19 $Fe_{bal.}Co_{7.8}Ni_{14.1}Si_{11.5}B_{8.9}Nb_{1.9}Cu_{0.9}Zr_{1.0}$ | 1.01 | 0.007 | 2.9 | 1.06 | Presence | 1.060 |
| | 20 $Fe_{bal.}Co_{9.2}Ni_{11.9}Si_{11.3}B_{8.8}Nb_{2.7}Cu_{0.9}Sn_{0.05}$ | 1.29 | 0.007 | 2.8 | 1.05 | Presence | 1.071 |
| | 21 $Fe_{bal.}Co_{5.5}Ni_{14.1}Si_{10.9}B_{9.2}Nb_{3.0}Cu_{0.9}P_{1.1}$ | 2.56 | 0.006 | 2.7 | 1.05 | Presence | 1.032 |
| | 22 $Fe_{bal.}Co_{9.8}Ni_{11.5}Si_{11.1}B_{9.0}Mo_{3.5}Cu_{0.9}$ | 1.17 | 0.005 | 2.6 | 1.04 | Presence | 1.071 |
| | 23 $Fe_{bal.}Co_{8.9}Ni_{12.3}Si_{11.1}B_{8.9}Ta_{2.5}Cu_{0.9}$ | 1.38 | 0.009 | 3.1 | 1.07 | Presence | 1.067 |
| | 24 $Fe_{bal.}Co_{9.5}Ni_{12.0}Si_{10.8}B_{9.3}Nb_{2.6}Cu_{0.9}W_{0.2}$ | 1.26 | 0.009 | 3.2 | 1.08 | Presence | 1.101 |
| | 25 $Fe_{bal.}Co_{9.5}Ni_{12.5}Si_{11.2}B_{9.0}Nb_{2.7}Cu_{1.5}V_{0.4}$ | 1.32 | 0.006 | 2.8 | 1.05 | Presence | 1.111 |
| Comparative Examples | 26 $Fe_{bal.}Ni_{14.2}Si_{11.1}B_{9.0}Nb_{3.3}Cu_{1.0}$ | — | 0.041 | 14.8 | 1.35 | Absence | — |
| | 27 $Fe_{bal.}Si_{11.3}B_{9.2}Nb_{2.8}Cu_{0.9}$ | — | 0.013 | 4.8 | 1.18 | Absence | — |
| | 28 $Fe_{bal.}Co_{0.5}Ni_{14.1}Si_{12.1}B_{9.0}Nb_{3.1}Cu_{1.1}$ | 28.20 | 0.019 | 8.9 | 1.24 | Absence | — |
| | 29 $Fe_{bal.}Co_{34.2}Si_{10.8}B_{9.3}Nb_{2.8}Cu_{0.7}$ | — | 0.026 | 10.7 | 1.27 | Presence | 1.242 |

In Example of the present invention indicated in No. 11 in which 20.0 atomic % of Co is contained, and the Co-concentrated region is clearly present directly below the Cu-concentrated region, the residual magnetic flux density Br, the coercive force Hc, and the change of the increment of relative permeability $\mu r_{\Delta}$ with respect to the magnetic field were preferably small. It is considered that the reason for this is because the ribbon includes the DC B—H curve which has small hysteresis with good linearity, and has non-steep and flat slope as a whole. In addition, such a result was the same as that in Examples of the present invention indicated in Nos. 12 to 25 in which Co in a range of 5 atomic % to 20 atomic % and Cu in a range of 0.5 atomic % to 1.5 atomic % are contained. In addition, in Example of the present invention indicated in No. 21 in which the ratio of Ni/Co is greater than 2.5, a large amount of inexpensive Ni was contained and thus it was possible to decrease the material cost as compared with Examples of the present invention indicated in Nos. 11 to 20 and Nos. 22 to 25 in which the ratio of Ni/Co is equal to or lower than 2.5.

In contrast, in the case where the clear Co-concentrated region was not present directly below the Cu-concentrated region or in Comparative Example indicated in No. 29 in

The invention claimed is:

1. An Fe-based soft magnetic alloy ribbon comprising an Fe-based soft magnetic alloy including Co of 5 atomic % or more and 20 atomic % or less and Cu of 0.5 atomic % or more and 1.5 atomic % or less, the Fe-based soft magnetic alloy ribbon comprising:

a Cu-concentrated region present directly below a surface of the ribbon, and a Co-concentrated region present directly below the Cu-concentrated region, wherein a peak value of Cu concentration in atomic percentage of the Cu-concentrated region is 2 times or more and 12 times or less with respect to an average value of the Cu concentration in atomic percentage which is measured in a depth from the surface of the ribbon in a range of 0.1 μm to 0.2 μm, and a peak value of Co concentration of the Co-concentrated region in atomic percentage is 1.02 times or more and 1.20 times or less with respect to an average value of the Co concentration in atomic percentage which is measured in a depth from the surface of the ribbon in a range of 0.1 μm to 0.2 μm.

2. The Fe-based soft magnetic alloy ribbon according to claim 1, the Fe-based soft magnetic alloy further comprising Ni of 15 atomic % or less and satisfying a relationship of $0.5 \leq c/b \leq 2.5$, wherein b is an amount of Co and c is an amount of Ni.

3. The Fe-based soft magnetic alloy ribbon according to claim 1, further comprising Si of 8 atomic % or more and 17 atomic % or less, B of 5 atomic % or more and 12 atomic % or less, and M of 1.7 atomic % or more and 5 atomic % or less, wherein M is at least one element selected from the group consisting of Mo, Nb, Ta, W, and V.

4. A magnetic core comprising the Fe-based soft magnetic alloy ribbon according to claim 1.

5. The magnetic core according to claim 4 which is used for a current transformer for detection of a half sine alternating current.

6. The Fe-based soft magnetic alloy ribbon according to claim 1, further comprising:

an oxide layer present on the surface of the ribbon, and an alloy layer present in an inside of the ribbon, wherein the Cu-concentrated region is present in a vicinity of a boundary with the oxide layer and the alloy layer.

7. The Fe-based soft magnetic alloy ribbon according to claim 1, wherein a peak of Cu concentration is present directly below the surface of the ribbon, and a peak of Co concentration is present directly below the peak of Cu concentration.

8. The Fe-based soft magnetic alloy ribbon according to claim 1, wherein the alloy includes Cu of 0.7 atomic % or more and 1.2 atomic % or less.

9. The Fe-based soft magnetic alloy ribbon according to claim 1, wherein the alloy includes Ni of 4 atomic % or more and 15 atomic % or less.

* * * * *